US009790665B2

(12) United States Patent
Tajima et al.

(10) Patent No.: US 9,790,665 B2
(45) Date of Patent: Oct. 17, 2017

(54) HYDRAULIC CONTROL DEVICE AND CONSTRUCTION MACHINE PROVIDED WITH SAME

(71) Applicant: KOBELCO CONSTRUCTION MACHINERY CO., LTD., Hiroshima-shi (JP)

(72) Inventors: Kazuharu Tajima, Hiroshima (JP); Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 472 days.

(21) Appl. No.: 14/371,314

(22) PCT Filed: Dec. 27, 2012

(86) PCT No.: PCT/JP2012/008376

§ 371 (c)(1),
(2) Date: Jul. 9, 2014

(87) PCT Pub. No.: WO2013/105199

PCT Pub. Date: Jul. 18, 2013

(65) Prior Publication Data

US 2015/0044007 A1 Feb. 12, 2015

(30) Foreign Application Priority Data

Jan. 11, 2012 (JP) ..... 2012-002963
Feb. 24, 2012 (JP) ..... 2012-038764

(51) Int. Cl.
*F15B 11/17* (2006.01)
*E02F 9/22* (2006.01)
(Continued)

(52) U.S. Cl.
CPC ..... *E02F 9/2296* (2013.01); *E02F 3/32* (2013.01); *E02F 3/425* (2013.01); *E02F 3/435* (2013.01);
(Continued)

(58) Field of Classification Search
CPC ..... F15B 11/162; F15B 11/165; F15B 11/167; F15B 11/17; F15B 2211/30565; F15B 2211/71
See application file for complete search history.

(56) References Cited

U.S. PATENT DOCUMENTS 5,673,558 A * 10/1997 Sugiyama ..... E02F 9/2228 60/426
5,996,341 A 12/1999 Tohji
(Continued)

FOREIGN PATENT DOCUMENTS

CN 1081268 C 3/2002
JP 4 194129 7/1992
(Continued)

OTHER PUBLICATIONS

Extended European Search Report dated Jul. 22, 2015 in Patent Application No. 12865273.2.
(Continued)

*Primary Examiner* — Thomas E Lazo
*Assistant Examiner* — Matthew Wiblin
(74) *Attorney, Agent, or Firm* — Oblon, McClelland, Maier & Neustadt, L.L.P.

(57) ABSTRACT

A hydraulic control device that reduces the loss of the power of a pump in combined operation of boom lowering and arm pushing. A controller performs single control of increasing capacity of a first pump in accordance with increase in an operation amount of a boom operation member, in a single operation of the boom lowering. On the other hand, the
(Continued)

controller restricts the capacity of the first pump compared to capacity in the single control, during a restriction control period when the combined operation of boom lowering and arm pushing is detected, and the operation amount of the boom operation member is a prescribed operation amount or more.

6 Claims, 6 Drawing Sheets

(51) Int. Cl.

| | |
|---|---|
| ***E02F 3/43*** | (2006.01) |
| ***E02F 3/32*** | (2006.01) |
| ***E02F 3/42*** | (2006.01) |
| *F15B 11/16* | (2006.01) |

(52) U.S. Cl.

CPC ..... *E02F 9/2235* (2013.01); *E02F 9/2239* (2013.01); *E02F 9/2282* (2013.01); *E02F 9/2285* (2013.01); *E02F 9/2292* (2013.01); *F15B 11/167* (2013.01); *F15B 11/17* (2013.01); *F15B 11/165* (2013.01); *F15B 2211/20546* (2013.01); *F15B 2211/20576* (2013.01); *F15B 2211/2654* (2013.01); *F15B 2211/2656* (2013.01); *F15B 2211/30565* (2013.01); *F15B 2211/31511* (2013.01); *F15B 2211/329* (2013.01); *F15B 2211/40507* (2013.01); *F15B 2211/41509* (2013.01); *F15B 2211/45* (2013.01); *F15B 2211/6316* (2013.01); *F15B 2211/6652* (2013.01); *F15B 2211/781* (2013.01)

(56) References Cited

U.S. PATENT DOCUMENTS

| | | | | |
|---|---|---|---|---|
| 7,487,609 | B2 * | 2/2009 | Nakamura | E02F 9/2075 37/348 |
| 2003/0172650 | A1 * | 9/2003 | Konishi | E02F 3/965 60/421 |
| 2007/0016349 | A1 * | 1/2007 | Oka | E02F 9/2242 701/50 |
| 2007/0028607 | A1 | 2/2007 | Ishikawa et al. | |
| 2010/0043420 | A1 * | 2/2010 | Ikeda | E02F 9/2239 60/420 |
| 2011/0192155 | A1 * | 8/2011 | Hagiwara | E02F 9/2239 60/421 |
| 2014/0090369 | A1 * | 4/2014 | Nakamura | E02F 9/2242 60/459 |

FOREIGN PATENT DOCUMENTS

| | | | | |
|---|---|---|---|---|
| JP | 6 34064 | | 5/1994 | |
| JP | 10 102547 | | 4/1998 | |
| JP | 2004 346485 | | 12/2004 | |
| JP | 2007 23606 | | 2/2007 | |
| JP | 2010-70978 | A | 4/2010 | |
| JP | 2010-190261 | A | 9/2010 | |
| JP | 2010190261 | A * | 9/2010 | F15B 11/02 |
| JP | 5572586 | B2 * | 8/2014 | E02F 9/2242 |
| KR | 10-2005-0083302 | A | 8/2005 | |
| KR | 10-0923396 | B1 | 10/2009 | |
| KR | 100923396 | B1 * | 10/2009 | E02F 9/20 |
| WO | WO 2012/157705 | A1 | 11/2012 | |

OTHER PUBLICATIONS

International Search Report dated Apr. 16, 2013 in PCT/JP12/008376 Filed Dec. 27, 2012.

* cited by examiner

HYDRAULIC CONTROL DEVICE AND CONSTRUCTION MACHINE PROVIDED WITH SAME

TECHNICAL FIELD

The present invention relates to a hydraulic control device that is provided in a construction machine having a boom and an arm.

BACKGROUND ART

As a construction machine that has a boom and an arm, for example, a hydraulic shovel described in Patent Document 1 is known.

The hydraulic shovel described in Patent Document 1 includes a boom cylinder that causes a boom to perform rising operation or lowering operation, an arm cylinder that causes an arm to perform pushing operation or pulling operation, a first hydraulic pump, and a second hydraulic pump.

Furthermore, the hydraulic shovel includes a control valve that belongs to a first group for controlling supply and discharge of hydraulic oil from the first hydraulic pump with respect to the boom cylinder and the arm cylinder, and a control valve that belongs to a second group for controlling supply and discharge of hydraulic oil from the second hydraulic pump with respect to the boom cylinder and the arm cylinder.

Specifically, the first and second groups include the control valve for a boom for controlling supply and discharge of hydraulic oil with respect to the boom cylinder, and the control valve for an arm for controlling supply and discharge of hydraulic oil with respect to the arm cylinder, respectively.

The control valve for a boom and the control valve for an arm have a center bypass passage connected in series by a tandem line, respectively. Additionally, the control valve for a boom and the control valve for an arm are connected in parallel to a first pump via a parallel circuit.

In the hydraulic shovel, arm pulling, and boom rising that is operation with a relatively higher load than the arm pulling are sometimes combined to be operated. In this combined operation, in order to suppress the supply of the hydraulic oil from the pumps only to the arm cylinder on the lower load side, the parallel circuit that belongs to the first group is provided with a restrictor.

Consequently, in the combined operation of arm pulling and boom rising, the hydraulic oil from the first pump can be preferentially guided to the boom cylinder.

However, the hydraulic shovel described in Patent Document 1 has a problem that the power of the first pump is lost in a case where arm pushing, and boom lowering that is operation with a relatively lower load than the arm pushing are combined to be operated.

Specifically, when the boom lowering operation is performed, an opening of the center bypass passage of the control valve for a boom is narrowed. As a result, the hydraulic oil from the pumps is guided to the control valve for an arm through the parallel circuit. However, this parallel circuit is provided with the restrictor, and therefore the hydraulic oil is guided preferentially to the boom cylinder on the lower load side than the arm cylinder. Therefore, extra hydraulic oil is supplied to the boom cylinder, thereby wasting the power of the first pump.

Particularly, the capacity of the pump can be generally controlled such that the capacity of the pump is increased in accordance with increase in a boom lowering operation amount. Therefore, the larger the boom lowering operation amount is, the larger the loss of the power is.

Patent Document 1: Japanese Unexamined Patent Publication No. 2007-23606

SUMMARY OF THE INVENTION

An object of the present invention is to reduce the loss of the power of a pump in combined operation of boom lowering and arm pushing.

In order to solve the problem, the present invention provides a hydraulic control device provided in a construction machine having a boom and an arm, which includes: a boom cylinder that causes the boom to perform rising operation or lowering operation; an arm cylinder that causes the arm to perform pushing operation or pulling operation with respect to the boom; a variable capacity type first pump; a second pump that is capable of supplying hydraulic oil to the arm cylinder; a boom operation member that receives operation for driving the boom; an arm operation member that receives operation for driving the arm; a boom side control valve that is capable of switching, in accordance with an operation amount of the boom operation member, between a supply position where the hydraulic oil is supplied to the boom cylinder, and a neutral position where the supply of the hydraulic oil to the boom cylinder is stopped and where an opening for allowing passage of the hydraulic oil is provided; an arm side control valve that controls supply and discharge of the hydraulic oil with respect to the arm cylinder by switching operation according to an operation amount of the arm operation member; a tandem circuit that connects the boom side control valve and the arm side control valve in series to the first pump such that the arm side control valve is located downstream of the boom side control valve; a parallel circuit that connects the boom side control valve and the arm side control valve in parallel to the first pump; a restrictor that is provided in the parallel circuit in order to guide the hydraulic oil from the first pump preferentially to the boom side control valve over the arm side control valve; a boom operation detection member that is capable of detecting the operation amount of the boom operation member; an arm operation detection member that is capable of detecting the operation amount of the arm operation member; and a control unit that performs single control of increasing capacity of the first pump in accordance with increase in the operation amount of the boom operation member, in a single operation of the boom lowering, wherein the control unit restricts the capacity of the first pump compared to capacity in the single control, during a restriction control period when combined operation of boom lowering and arm pushing is detected by the respective detection members, and the operation amount of the boom operation member is a prescribed operation amount or more.

The present invention provides a construction machine that includes: a machine body; a boom that is capable of performing rising operation or lowering operation with respect to the machine body; an arm that is capable of performing pushing operation or pulling operation with respect to the boom; and the hydraulic control device that controls driving of the boom and the arm.

According to the present invention, it is possible to reduce the loss of the power of the pump in combined operation of boom lowering and arm pushing.

BEST MODE FOR CARRYING OUT THE INVENTION

In the following, embodiments of the present invention will be described with reference to the accompanying drawings. The embodiments are merely examples embodying the invention, and do not limit the technical scope of the invention.

[First Embodiment (FIG. 1 to FIG. 6)]

Figure 1:
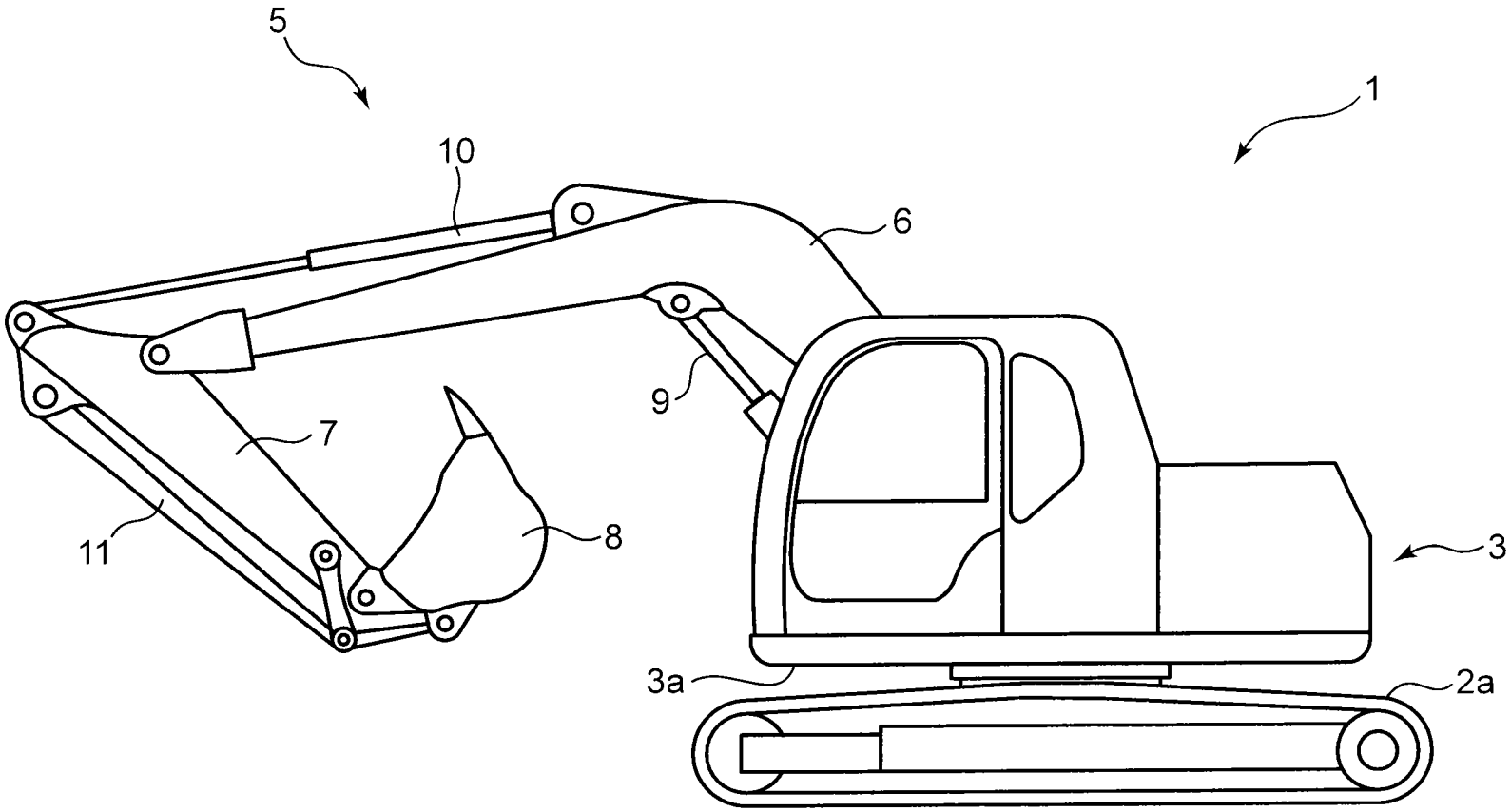
FIG. 1 is a left side view showing a whole configuration of a hydraulic shovel according to a first embodiment of the present invention.
Figure 2:
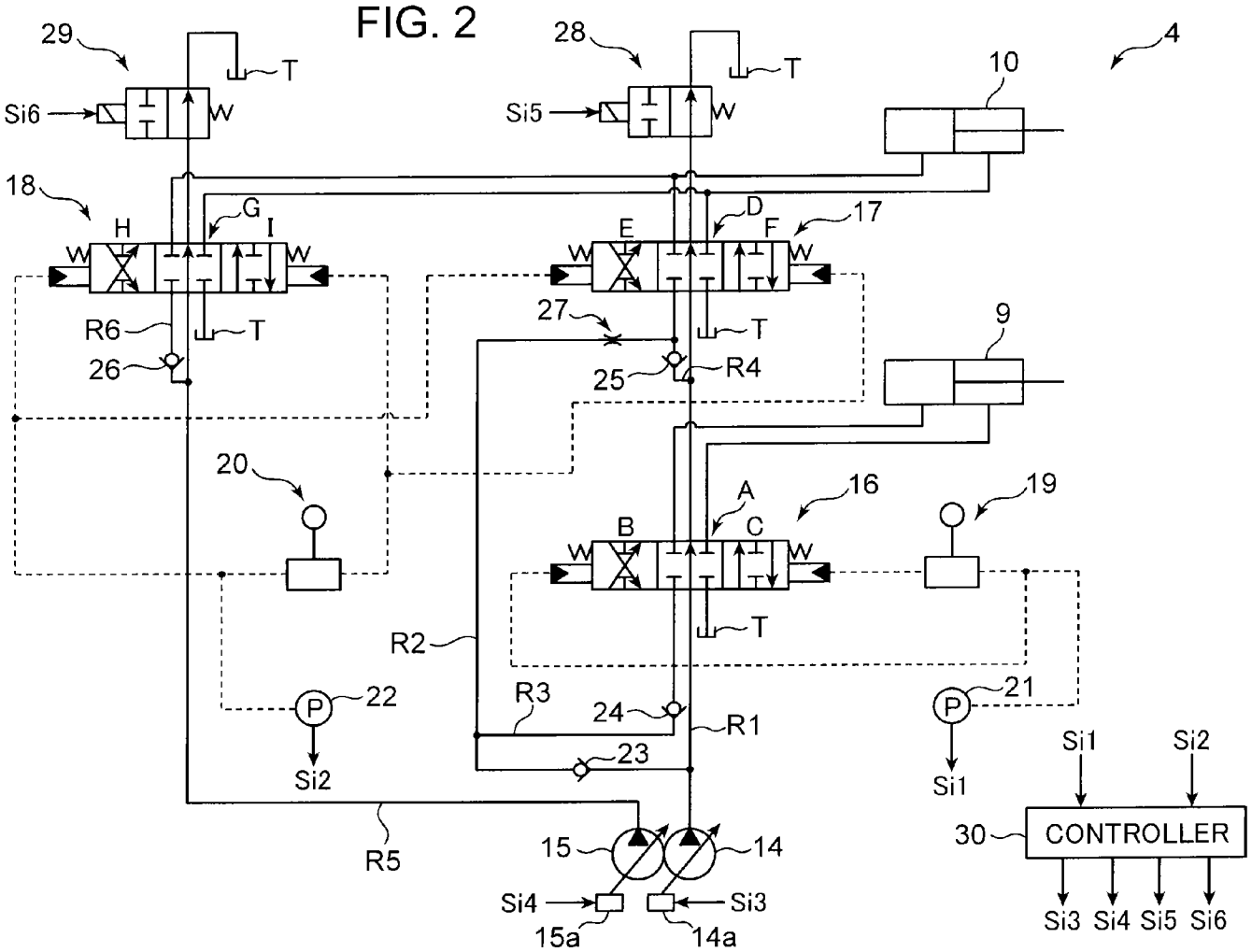
FIG. 2 is a circuit diagram showing a hydraulic control device provided in the hydraulic shovel shown in FIG. 1.

As shown in FIG. 1, a hydraulic shovel 1 according to a first embodiment includes a lower traveling body 2 that has a crawler 2*a*, an upper slewing body 3 that is provided on the lower traveling body 2 in a state of being turnable about an axis perpendicular to the ground, and a hydraulic control device 4 shown in FIG. 2.

The upper slewing body 3 has a slewing frame 3*a* that is provided to be turnable with respect to the lower traveling body 2, and a working attachment 5 that can be raised and lowered with respect to the slewing frame 3*a*.

The working attachment 5 has a boom 6 that has a proximal end mounted to enable to be raised and lowered with respect to the slewing frame 3*a*, an arm 7 that has a proximal end mounted swingably with respect to the distal end of the boom 6, and a bucket 8 that is mounted swingably with respect to the distal end of the arm 7.

Additionally, the working attachment 5 includes a boom cylinder 9 that raises and lowers the boom 6 with respect to the slewing frame 3*a*, an arm cylinder 10 that causes the arm 7 to swing with respect to the boom 6, and a bucket cylinder 11 that causes the bucket 8 to swing with respect to the arm 7. Specifically, the boom cylinder 9 extends, thereby performing the rising operation of the boom 6, while the boom cylinder 9 contracts, thereby performing the lowering operation of the boom 6. Additionally, the arm cylinder 10 extends, thereby performing the pulling operation of the arm 7, while the arm cylinder 10 contracts, thereby performing the pushing operation of the arm 7.

With reference to FIG. 2, the hydraulic control device 4 includes the boom cylinder 9, the arm cylinder 10, a first pump 14 and a second pump 15 that are driven by an engine (not shown), a boom side control valve 16 that is provided between the first pump 14 and the boom cylinder 9, a first arm side control valve 17 that is provided between the first pump 14 and the arm cylinder 10, a second arm side control valve 18 that is provided between the second pump 15 and the arm cylinder 10, a boom operation member 19 for performing the switching operation of the boom side control valve 16, an atm operation member 20 for performing the switching operation of each of the arm side control valves 17 and 18, a tandem circuit R1 that connects the boom side control valve 16 and the first arm side control valve 17 in series to the first pump 14, a parallel circuit, described later, that connects the boom side control valve 16 and the first arm side control valve 17 in parallel to the first pump 14, a restrictor 27 that is provided in the parallel circuit, a main line R5 that connects the second pump 15 and the second arm side control valve 18, a boom operation sensor (boom operation detection member) 21 that is capable of detecting the operation amount of the boom operation member 19, an arm operation sensor (arm operation detection member) 22 that is capable of detecting the operation amount of the arm operation member 20, a controller 30, a third pilot valve 25, a fourth pilot valve 26, a first switching valve 28, and a second switching valve 29.

The first pump 14 and the second pump 15 are variable capacity type pumps. Specifically, the first pump 14 has a regulator 14*a* that is capable of adjusting the capacity thereof. Similarly, the second pump 15 has a regulator 15*a* that is capable of adjusting the capacity thereof.

The boom side control valve 16 controls the supply and discharge of hydraulic oil with respect to the boom cylinder 9. Specifically, the boom side control valve 16 is biased to a neutral position A in a state where the boom operation member 19 is not operated, and is switchable from the neutral position A toward a boom lowering position B or a boom rising position C in accordance with the operation amount of the boom operation member 19. At the neutral position A, a center bybass opening is provided. In a state where the boom side control valve 16 is at the neutral position A, hydraulic oil from the first pump 14 is not supplied to the boom cylinder 9, and passes the center bybass opening. When the boom side control valve 16 is switched to the boom lowering position B, the boom cylinder 9 contracts, so that the boom 6 is lowered. When the boom side control valve 16 is switched to the boom rising position C, the boom cylinder 9 extends, so that the boom 6 is raised.

The first arm side control valve 17 controls the supply and discharge of hydraulic oil from the first pump 14 with respect to the arm cylinder 10. Specifically, the first arm side control valve 17 is biased to a neutral position D in a state where the arm operation member 20 is not operated, and is switchable from the neutral position D toward an arm pushing position E or an arm pulling position F in accordance with the operation amount of the arm operation member 20. At the neutral position D, a center bybass opening is provided. In a state where the first arm side control valve 17 is at the neutral position D, the hydraulic oil from the first pump 14 is not supplied to the arm cylinder 10, and passes the center bybass opening. When the first arm side control valve 17 is switched to the arm pushing position E, the arm cylinder 10 contracts, so that the arm 7 swings to a push direction. When the first arm side control valve 17 is switched to the arm pulling position F, the arm cylinder 10 extends, so that the arm 7 swings in a pull direction.

The second arm side control valve 18 controls the supply and discharge of hydraulic oil from the second pump 15 with respect to the arm cylinder 10. Specifically, the second arm side control valve 18 is biased to a neutral position G in a state where the arm operation member 20 is not operated, and is switchable from the neutral position G toward an arm pushing position H or an arm pulling position I in accordance with the operation amount of the arm operation member 20. At the neutral position G, a center bybass opening is provided. The operation of the arm 7 according to the switching position of the second arm side control valve 18 is similar to the case of the first arm side control valve 17.

The tandem circuit R1 connects the boom side control valve 16 and the first arm side control valve 17 in series to the first pump 14 such that the first arm side control valve 17 is located downstream of the boom side control valve 16. Consequently, in a state where the boom side control valve 16 is biased to the neutral position A, the hydraulic oil from the first pump 14 is guided to the first arm side control valve 17 through the center bybass opening of the boom side control valve 16. Furthermore, in a state where the first arm side control valve 17 is biased to the neutral position D, the hydraulic oil from the first pump 14 is guided to a tank T through the center bybass opening of the first arm side control valve 17. The flow rate of the hydraulic oil guided to the tank T is adjusted by the first switching valve 28 provided on a more downstream side than the first arm side control valve 17.

The parallel circuit includes a first parallel line R2 that is connected to the first arm side control valve 17 from the first pump 14 not via the boom side control valve 16, a second parallel line R3 that connects the first parallel line R2 and the boom side control valve 16, a first pilot valve 23 that is provided on the first parallel line R2, and a second pilot valve 24 that is provided on the second parallel line R3. The first parallel line R2 branches from the tandem circuit R1 on a more upstream side than the boom side control valve 16, to be connected to a pump port of the first arm side control valve 17. The second parallel line R3 branches from the first parallel line R2 on a more downstream side than the first pilot valve 23, to be connected to a pump port of the boom side control valve 16. The first pilot valve 23 allows the flows of hydraulic oil from the first pump 14 toward the respective control valves 16 and 17, while regulating reverse flows. The second pilot valve 24 allows the flow of hydraulic oil from the first pump 14 toward the boom side control valve 16, while regulating a reverse flow.

The restrictor 27 is provided in the parallel circuit so as to generate a pressure loss for guiding the hydraulic oil from the first pump preferentially to the boom side control valve 16 over the first arm side control valve 17. Specifically, the restrictor 27 is provided on a more downstream side than a branch point of the second parallel line R3 in the first parallel line R2.

The downstream position of the restrictor 27 in the first parallel line R2, and a position between the boom side control valve 16 and the first arm side control valve 17 in the tandem circuit R1 are connected by a supply line R4. On this supply line R4, the third pilot valve 25 is provided. The third pilot valve 25 allows the flow of hydraulic oil from the tandem circuit R1 toward the first parallel line R2, while regulating a reverse flow. Therefore, hydraulic oil that flows through the tandem circuit R1 can be guided to the pump port of the first arm side control valve 17.

A supply line R6 is provided between a position on a more upstream side than the second arm side control valve 18 in the main line R5 connected to the second pump 15, and a pump port of the second arm side control valve 18. On the supply line R6, the fourth pilot valve 26 is provided. The fourth pilot valve 26 allows the flow of hydraulic oil from the main line R5 toward the second arm side control valve 18, while regulating a reverse flow. Furthermore, the second switching valve 29 is provided on a more downstream side than the second arm side control valve 18 in the main line R5. The second switching valve 29 is capable of adjusting the flow rate of hydraulic oil guided to the tank T through the main line R5.

The boom operation sensor is capable of detecting the operation amount of the boom operation member 19. FIG. 2 shows only the boom operation sensor 21 that detects pilot pressure for causing the boom 6 to perform lowering operation, and outputs a detection signal Si1 to the controller 30, and does not show a boom operation sensor that detects pilot pressure for causing the boom 6 to perform rising operation.

The arm operation sensor is capable of detecting the operation amount of the arm operation member 20. FIG. 2 shows only the arm operation sensor 22 that detects pilot pressure for causing the arm 7 to perform pushing operation, and outputs a detection signal Si2 to the controller 30, and does not show an arm operation sensor that detects pilot pressure for causing the arm 7 to perform pulling operation.

The controller 30 can control the capacity of each of the pumps 14 and 15, and the operation amount of each of the switching valves 28 and 29. Specifically, the controller 30 outputs control signals Si3 to Si6 to respective solenoids of the switching valves 28 and 29 and the regulators 14*a* and 15*a*, on the basis of the respective detection signals Si 1 and Si2 from the operation sensors 21 and 22.

Figure 3:
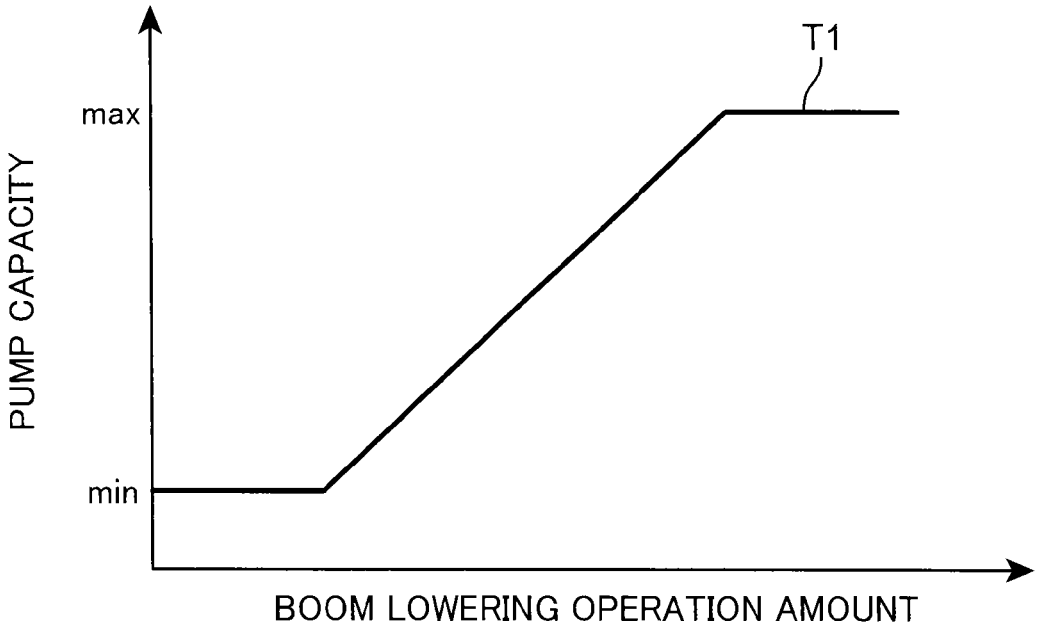
FIG. 3 is a graph showing the control of the pump capacity of a first pump by a controller shown in FIG. 2, and shows control in single boom lowering operation.
Figure 4:
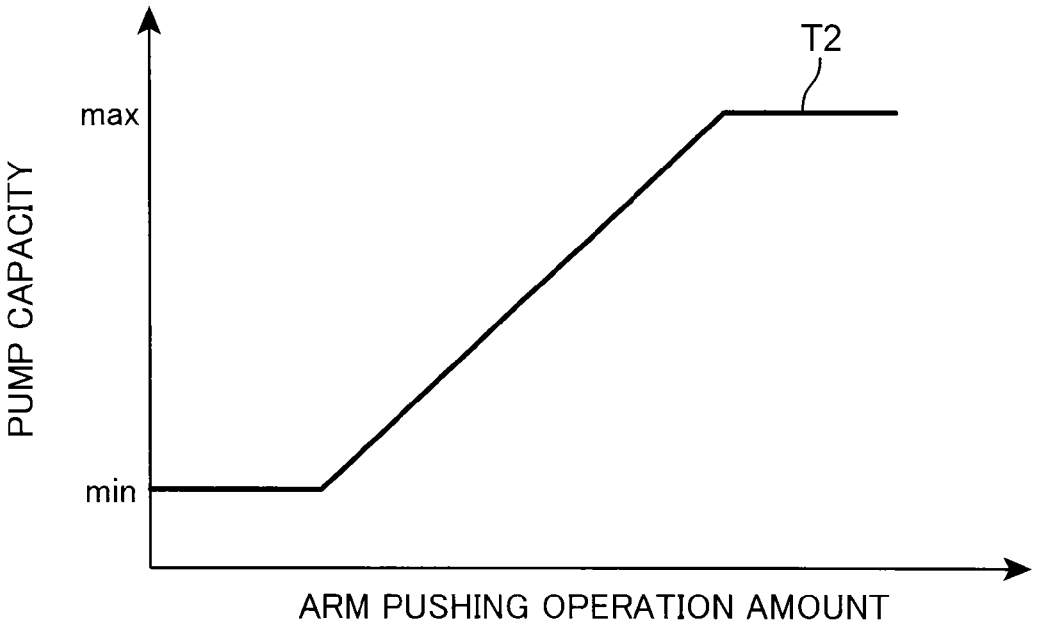
FIG. 4 is a graph showing the control of the pump capacity of a first pump by a controller shown in FIG. 2, and shows control in single arm pushing operation.
Figure 5:
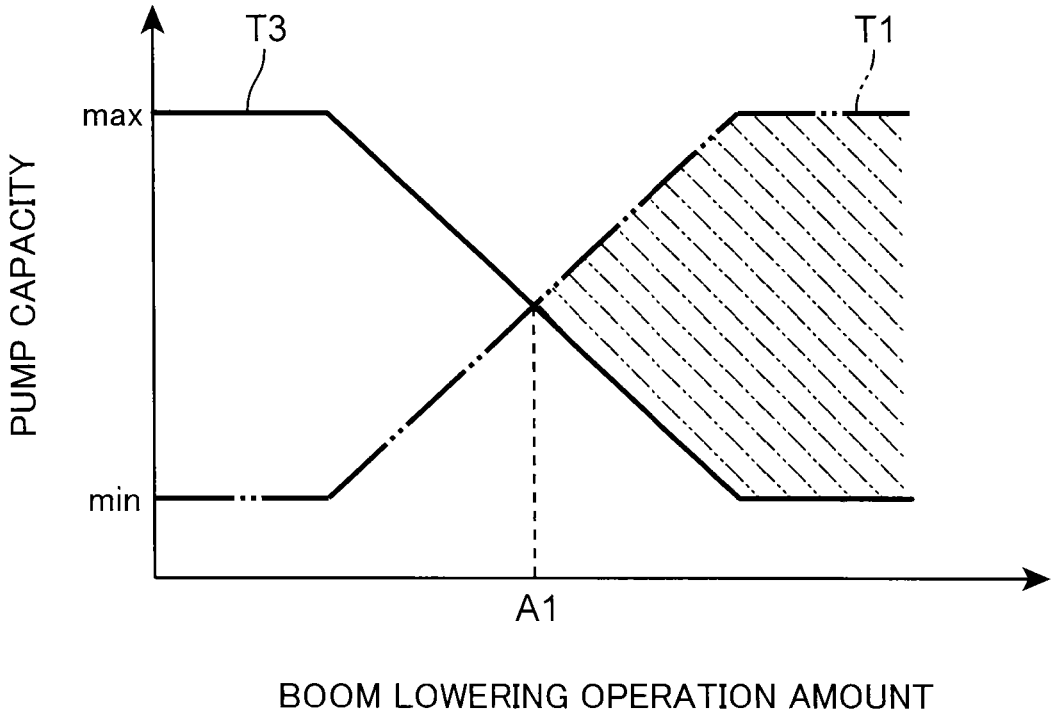
FIG. 5 is a graph showing the control of the pump capacity of a first pump by a controller shown in FIG. 2, and shows prescribed upper limit capacity according to a boom lowering operation amount.

The controller 30 stores capacity characteristics of the first pump 14, shown in FIG. 3 to FIG. 5.

FIG. 3 shows a capacity characteristic T1 of the first pump 14 according to the operation amount of the boom operation member 19, in a case where boom lowering operation is singly performed. In the capacity characteristic T1, capacity increases in accordance with increase in the operation amount of the boom lowering. Specifically, in a predetermined range from a minimum operation amount of the boom operation member 19, the capacity of the first pump 14 is fixed to a minimum value min, regardless of the operation amount of the boom operation member 19. Additionally, in a predetermined range which is less than a maximum operation amount of the boom operation member 19, the capacity of the first pump 14 is fixed to a maximum value max, regardless of the operation amount of the boom operation member 19. Except these ranges, the capacity of the first pump 14 increases in accordance with increase in the operation amount of the boom operation member 19. Each of the ranges can be omitted. That is, the capacity characteristic T1 in which "the capacity increases in accordance with increase in the boom lowering operation amount", includes a case where the range, in which the capacity is fixed to the minimum value min, and the range, in which the capacity is fixed to the maximum value max, are set.

FIG. 4 shows a capacity characteristic (arm necessary capacity) T2 of the first pump 14 according to the operation amount of the arm operation member 20, in a case where arm pushing operation is singly performed. In the capacity characteristic T2, capacity increases in accordance with increase in the operation amount of the arm pushing. Specifically, in a predetermined range from a minimum operation amount of the arm operation member 20, the capacity of the first pump 14 is fixed to a minimum value min, regardless of the operation amount of the arm operation member 20. Additionally, in a predetermined range which is less than a maximum operation amount of the arm operation member 20, the capacity of the first pump 14 is fixed to a maximum value max, regardless of the operation amount of the arm operation member 20. Except these ranges, the capacity of the first pump 14 increases in accordance with increase in the operation amount of the arm operation member 20. Each of the ranges can be omitted. That is, the capacity characteristic T2 in which "the capacity increases in accordance with increase in the arm pushing operation amount", includes a case where the range, in which the capacity is fixed to the minimum value min, and the range, in which the capacity is fixed to the maximum value max, are set.

FIG. 5 shows a capacity characteristic (prescribed upper limit capacity) T3 of the first pump 14 according to the operation amount of the boom operation member 19 in a case where combined operation of arm pushing and boom lowering is performed. In the capacity characteristic T3, capacity decreases in accordance with increase in the operation amount of the boom lowering. Specifically, in a predetermined range from a minimum operation amount of the boom operation member 19, the capacity of the first pump 14 is fixed to a maximum value max, regardless of the operation amount of the boom operation member 19. Additionally, in a predetermined range which is less than a maximum operation amount of the boom operation member 19, the capacity of the first pump 14 is fixed to a minimum value min, regardless of the operation amount of the boom operation member 19. Except these ranges, the capacity of the first pump 14 decreases in accordance with increase in the operation amount of the boom operation member 19. Each of the ranges can be omitted. That is, the capacity characteristic T3 in which "the capacity decreases in accordance with increase in the boom lowering operation amount", includes a case where the range, in which the capacity is fixed to the minimum value min, and the range, in which the capacity is fixed to the maximum value max, are set.

Then, in a case where the combined operation of arm pushing and boom lowering is performed, the controller 30 controls the capacity of the first pump 14 to the capacity characteristic T3 or less. Consequently, in a range in which the boom lowering operation amount is larger than an intersection (prescribed operation amount) A1 of the capacity characteristic T1 in the single boom lowering operation, and the capacity characteristic T3 in the combined operation, the capacity of the first pump 14 is more greatly restricted than capacity in the single boom lowering operation. Therefore, also in the combined operation of arm pushing and boom lowering, the capacity of the first pump 14 can be reduced in a range shown by hatching in FIG. 5, compared to a case where control based on the capacity characteristic T1 is performed. Accordingly, it is possible to reduce the loss of the power of the first pump 14.

Furthermore, the controller 30 controls the capacity of the first pump 14 to smaller capacity among capacity identified by the capacity characteristic T2, and capacity identified by the capacity characteristic T3. Consequently, in a case where the capacity identified by the capacity characteristic T2 is smaller than the capacity identified by the capacity characteristic T3, namely, in case where capacity necessary for the arm pushing is smaller than an upper limit value of capacity defined by the boom lowering, the capacity of the first pump 14 can be further reduced.

Figure 6:
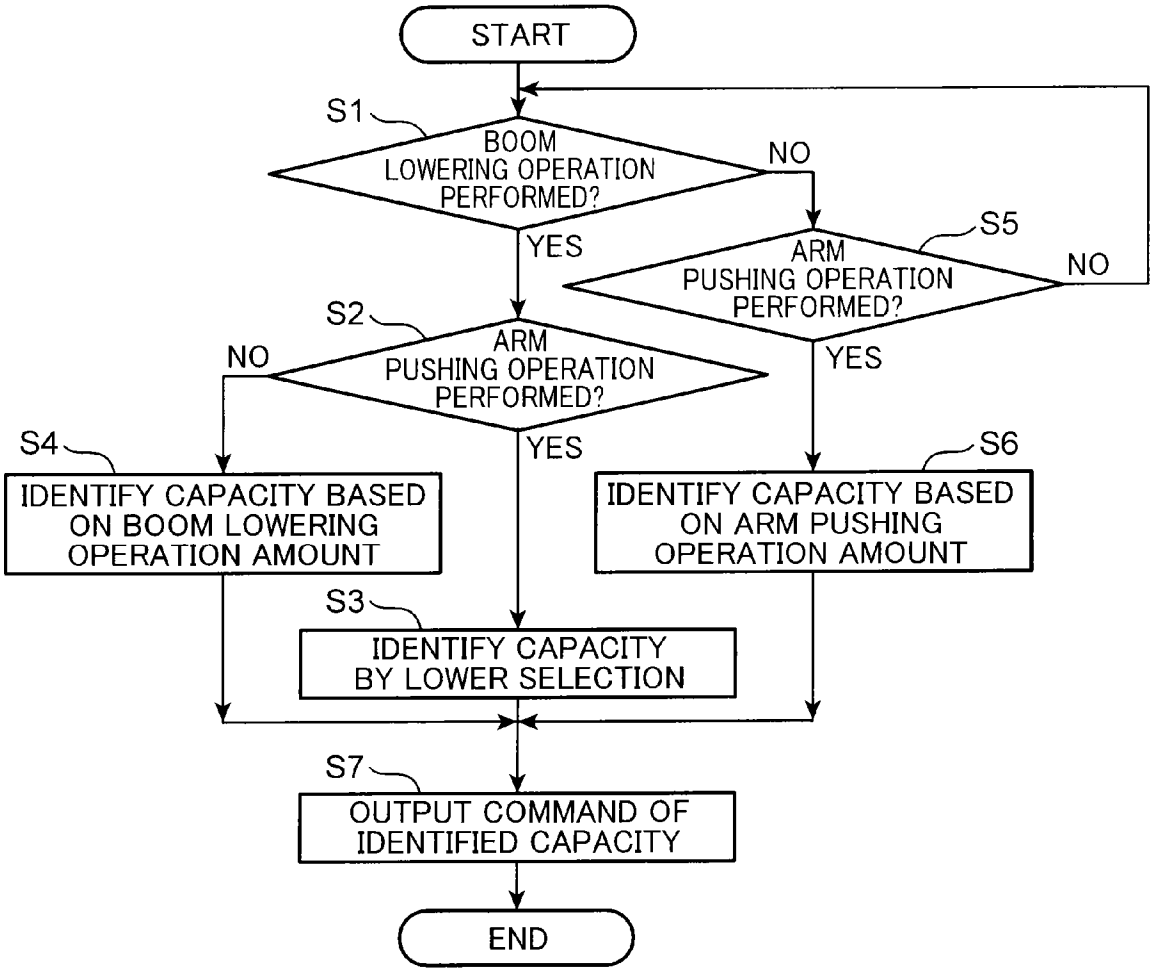
FIG. 6 is a flowchart showing processes performed by the controller shown in FIG. 2.

Hereinafter, processes performed by the controller 30 will be described with reference to FIG. 6.

When the process performed by the controller 30 starts, it is determined on the basis of a result of detection by the boom operation sensor 21 whether or not boom lowering operation is performed by the boom operation member 19 (Step S1). When it is determined that the boom lowering operation is performed, it is determined on the basis of a result of detection by the arm operation sensor 22 whether or not arm pushing operation is performed by the arm operation member 20 (Step S2).

In Step S2, in a case where it is determined that the arm pushing operation is performed, namely, in a case where combined operation of boom lowering and arm pushing is performed, lower selection among the capacity characteristic T2 shown in FIG. 4 and the capacity characteristic T3 shown in FIG. 5 is performed (Step S3). Consequently, it is possible to restrict the capacity of the first pump 14 to the upper limit value of the capacity defined by the capacity characteristic T3, or the capacity necessary for arm pushing defined by the capacity characteristic T2.

In a case where it is determined that the boom lowering operation is not performed, in Step S1, it is determined whether or not the arm pushing operation is performed by the arm operation member 20 (Step S5). When it is determined that the arm pushing operation is not performed, the process returns to Step S1. On the other hand, in a case where it is determined that the arm pushing operation is performed, namely, in a case where it is determined that the single arm pushing operation is performed, the capacity is identified on the basis of the capacity characteristic T2 shown in FIG. 4 and the arm pushing operation amount (Step S6).

In a case where it is determined that the arm pushing operation is not performed, in Step S2, namely, in a case where it is determined that the single boom lowering operation is performed, the capacity is identified on the basis of the capacity characteristic T1 shown in FIG. 3 and the boom lowering operation amount (Step S4).

Then, a control signal Si3 based on the capacity identified in Step S3, S4, or S6 is output to the regulator 14*a* of the first pump 14 (Step S7), the processes are terminated.

As described above, in the embodiment, during a restriction control period when the combined operation of boom lowering and arm pushing is detected (YES in Steps S1 and S2), and the operation amount of the boom operation member 19 is a prescribed operation amount A1 (see FIG. 5) or more, the capacity of the first pump 14 is restricted compared to the capacity defined by the capacity characteristic T1 in the single boom lowering operation. Consequently, in a situation where most of hydraulic oil from the first pump 14 is preferentially supplied to the boom cylinder 9, the supply of excessive hydraulic oil to the boom cylinder 9 is suppressed, so that the loss of the power of the first pump 14 can be reduced.

Therefore, according to the embodiment, it is possible to reduce the loss of the power of the first pump 14 in the combined operation of boom lowering and arm pushing.

In the embodiment, the capacity of the first pump 14 is controlled to the preset capacity characteristic T3 or less. Therefore, it is possible to simplify the control performed by the controller 30, compared to a case where each time the boom lowering operation amount is changed, the capacity of the first pump 14 according to this operation amount is calculated.

The center bybass opening of the boom side control valve 16 is narrowed in accordance with increase in the operation amount of the boom operation member 19, thereby restricting the flow rate of hydraulic oil that can be guided to the arm cylinder 10 from the first pump 14. In the embodiment, the capacity of the first pump 14 is controlled to at most the capacity characteristic T3 that decreases in accordance with the increase in the operation amount of the boom operation member 19. Therefore, it is possible to effectively reduce the loss of the power of the first pump 14 in accordance with change in the operation amount of the boom operation member 19.

In the embodiment, the capacity of the first pump 14 is controlled to smaller capacity among the capacity characteristic T2 according to the arm pushing operation amount, and the capacity characteristic T3 according to the boom lowering operation amount (Steps S3 and S7). Consequently, in a case where the capacity necessary for the arm pushing is in a range of the capacity identified by the capacity characteristic T3, the capacity of the first pump 14 is further decreased from the capacity characteristic T3, and the loss of the power of the first pump 14 can be more effectively reduced.

In the embodiment, the capacity of the first pump 14 is controlled to smaller capacity among the capacity identified by the capacity characteristic T2, and the capacity identified by the capacity characteristic T3, in the whole operation range of the boom operation member 19. Consequently, it is possible to effectively supply hydraulic oil to the arm cylinder 10, in a situation where the operation amount of the boom operation member 19 is small, namely, in a situation where the center bybass opening of the boom side control valve 16 is hardly narrowed. Therefore, it is possible to suppress rapid decrease in the capacity of the first pump 14, in a case where the boom operation member 19 is operated a little from a non-operation state in a state where the operation amount of the arm operation member 20 is maximum, for example.

In the embodiment, the maximum value (max) of the capacity characteristic T3 is equivalent to the maximum value (max) of the capacity characteristic T2. Consequently, it is possible to set the capacity of the first pump 14 to a maximum value of the capacity necessary for the arm pushing (capacity identified by the capacity characteristic T2) in a state where the operation amount of the boom operation member 19 is minimum.

[Second Embodiment (FIG. 7 and FIG. 8)]

Although the capacity of the first pump 14 is controlled to at most the capacity characteristic T3 that decreases in accordance with the increase in the boom lowering operation amount, as shown in FIG. 5, in the first embodiment, the capacity of the first pump 14 is not limited. Specifically, as in a second embodiment described later, the capacity may be restricted to be lower than capacity identified by the capacity characteristic T1 in single boom lowering operation, in a range where a boom lowering operation amount is a preset operation amount A1 or more.

Figure 7:
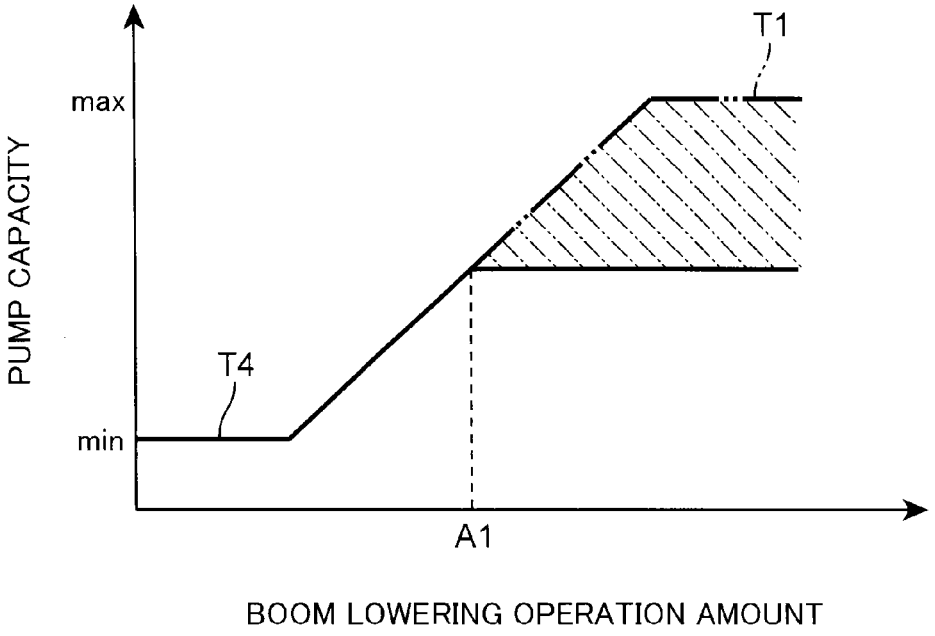
FIG. 7 is a diagram corresponding to FIG. 5, according to a second embodiment of the present invention.

A controller 30 according to the second embodiment previously stores a capacity characteristic T4 shown in FIG. 7. The range of the capacity characteristic T4 from a minimum operation amount of boom lowering to the operation amount A1 is the same as the range of the capacity characteristic T1 in single boom lowering operation (see FIG. 3). On the other hand, the range of the capacity characteristic T4 larger than the operation amount A1 is made constant regardless of the boom lowering operation amount. Therefore, the capacity is identified on the basis of the capacity characteristic T4, so that the capacity can be restricted by a range shown by hatching, compared to a case where the capacity characteristic T1 in the single boom lowering operation is used. In the capacity characteristic T4, capacity in a range of the operation amount A1 or more is set constant. However, the capacity in a range of the operation amount A1 or more may be set so as to increase in accordance with an operation amount at a more gentle gradient than the capacity characteristic T1.

Figure 8:
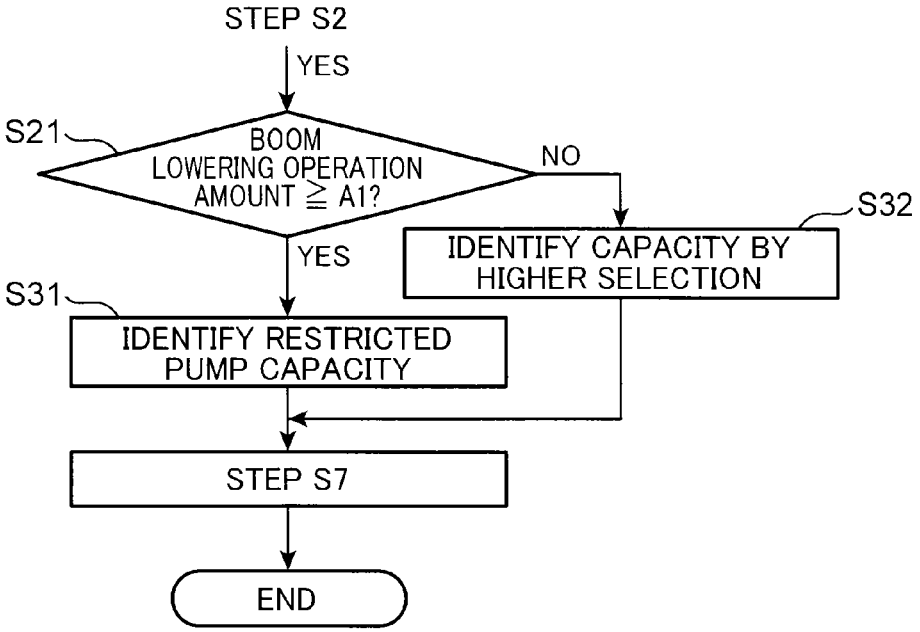
FIG. 8 is a diagram corresponding to FIG. 6, according to the second embodiment of the present invention.

Hereinafter, processes performed by the controller 30 according to the second embodiment will be described with reference to FIG. 8. Only parts different from the processes shown in FIG. 6 will be described.

In a case where it is determined that arm pushing operation is performed in the Step S2, namely, in a case where it is determined that combined operation of boom lowering and arm pushing is performed, it is determined whether or not the boom lowering operation amount is the operation amount A1 or more (Step S21).

When it is determined that the boom lowering operation amount is the operation amount A1 or more, in Step S21, the capacity is identified on the basis of the capacity characteristic T4 shown in FIG. 7 and a boom lowering operation amount (Step S31). Consequently, it is possible to greatly restrict the capacity of the first pump 14 compared to the capacity identified on the basis of the capacity characteristic T1 in the single boom lowering operation.

On the other hand, when it is determined that the boom lowering operation amount is less than the operation amount A1, in Step S21, the capacity is identified by higher selection among the capacity characteristic T4 shown in FIG. 7 and the capacity characteristic T2 shown in FIG. 4 (Step S32). Consequently, in a case where the boom lowering operation amount is relatively small, namely, in a case where a center bybass opening of a boom side control valve 16 is hardly narrowed, hydraulic oil necessary for arm pushing operation can be effectively guided to a first arm side control valve 17.

In each of the embodiments, the operation amount A1 is preset as an operation amount, in which the percentage of hydraulic oil, which can be guided to the first arm side control valve 17 through the center bybass opening of the boom side control valve 16, in hydraulic oil from the first pump 14, is a predetermined value or less.

The specific embodiments mainly include the invention that has the following configurations.

That is, the present invention provides a hydraulic control device provided in a construction machine having a boom and an arm, which includes: a boom cylinder that causes the boom to perform rising operation or lowering operation; an arm cylinder that causes the arm to perform pushing operation or pulling operation with respect to the boom; a variable capacity type first pump; a second pump that is capable of supplying hydraulic oil to the arm cylinder; a boom operation member that receives operation for driving the boom; an arm operation member that receives operation for driving the arm; a boom side control valve that is capable of switching, in accordance with an operation amount of the boom operation member, between a supply position where the hydraulic oil is supplied to the boom cylinder, and a neutral position where the supply of the hydraulic oil to the boom cylinder is stopped and where an opening for allowing passage of the hydraulic oil is provided; an arm side control valve that controls supply and discharge of the hydraulic oil with respect to the arm cylinder by switching operation according to an operation amount of the arm operation member; a tandem circuit that connects the boom side control valve and the arm side control valve in series to the first pump such that the arm side control valve is located downstream of the boom side control valve; a parallel circuit that connects the boom side control valve and the arm side control valve in parallel to the first pump; a restrictor that is provided in the parallel circuit in order to guide the hydraulic oil from the first pump preferentially to the boom side control valve over the arm side control valve; a boom operation detection member that is capable of detecting the operation amount of the boom operation member; an arm operation detection member that is capable of detecting the operation amount of the arm operation member; and a control unit that performs single control of increasing capacity of the first pump in accordance with increase in the operation amount of the boom operation member, in a single operation of the boom lowering, wherein the control unit restricts the capacity of the first pump compared to capacity in the single control, during a restriction control period when combined operation of boom lowering and arm pushing is detected by the respective detection members, and the operation amount of the boom operation member is a prescribed operation amount or more.

In the present invention, during the restriction control period when the combined operation of boom lowering and arm pushing is detected, and the operation amount of the boom operation member is a prescribed operation amount or more, the capacity of the first pump is restricted compared to the capacity in the single control. Consequently, in a situation where most of hydraulic oil from the first pump is preferentially supplied to the boom cylinder, the supply of excessive hydraulic oil to the boom cylinder is suppressed, so that the loss of the power of the first pump can be reduced.

Therefore, according to the present invention, it is possible to reduce the loss of the power of the pump in the combined operation of boom lowering and arm pushing.

The prescribed operation amount is preset as an operation amount, in which the percentage of hydraulic oil, which can be guided to the arm side control valve through the opening of the boom side control valve, in hydraulic oil from the first pump, is a predetermined value or less.

In the hydraulic control device, the control unit preferably controls the capacity of the first pump to at most prescribed upper limit capacity which is preset such that the capacity of the first pump is smaller than the capacity in the single control, during the restriction control period.

In this aspect, the capacity of the first pump is controlled to at most the prescribed upper limit capacity that is preset. Therefore, it is possible to simplify the control performed by the control unit, compared to a case where each time the boom lowering operation amount is changed, the capacity of the first pump according to this operation amount is calculated.

In the hydraulic control device, the prescribed upper limit capacity is preferably set so as to decrease in accordance with increase in the operation amount of the boom operation member, in a range of the prescribed operation amount or more.

The opening of the boom side control valve is narrowed in accordance with increase in the operation amount of the boom operation member, thereby restricting the flow rate of hydraulic oil that can be guided to the arm cylinder from the first pump. In this aspect, the capacity of the first pump is controlled to at most the prescribed upper limit capacity that decreases in accordance with the increase in the operation amount of the boom operation member. Therefore, it is possible to effectively reduce the loss of the power of the first pump in accordance with change in the operation amount of the boom operation member.

In the hydraulic control device, the control unit preferably stores arm necessary capacity that is a characteristic of the capacity of the first pump and is set so as to increase in accordance with increase in the operation amount of the arm operation member, and controls the capacity of the first pump to smaller capacity among the arm necessary capacity and the prescribed upper limit capacity, during the restriction control period.

In this aspect, the capacity of the first pump is controlled to the smaller capacity among the arm necessary capacity and the prescribed upper limit capacity. Consequently, in a case where the arm necessary capacity is in a range of the prescribed upper limit capacity, the capacity of the first pump is further decreased from the prescribed upper limit capacity, and the loss of the power of the first pump can be more effectively reduced.

In the hydraulic control device, the prescribed upper limit capacity is preferably set so as to decrease in accordance with increase in the operation amount of the boom operation member, also in a range of less than the prescribed operation amount, and the control unit preferably stores arm necessary capacity that is a characteristic of the capacity of the first pump and is set so as to increase in accordance with increase in the operation amount of the arm operation member, and controls the capacity of the first pump to smaller capacity among the arm necessary capacity and the prescribed upper limit capacity, in a whole operation range of the boom operation member, in a case where the combined operation of boom lowering and arm pushing is detected.

According to this aspect, it is possible to effectively supply hydraulic oil to the arm cylinder, in a situation where the operation amount of the boom operation member is small, namely, in a situation where the opening of the boom side control valve is hardly narrowed. Therefore, it is possible to suppress rapid decrease in the capacity of the first pump, in a case where the boom operation member is operated a little from a non-operation state of the boom operation member in a state where the operation amount of the arm operation member is maximum, for example.

In the hydraulic control device, a maximum value of the prescribed upper limit capacity is preferably set to be equivalent to or larger than a maximum value of the arm necessary capacity.

According to this aspect, it is possible to set the capacity of the first pump to a maximum value of the arm necessary capacity in a state where the operation amount of the boom operation member is minimum.

The present invention provides a construction machine that includes: a machine body; a boom that is capable of performing rising operation or lowering operation with respect to the machine body; an arm that is capable of performing pushing operation or pulling operation with respect to the boom; and the hydraulic control device that controls driving of the boom and the arm.

INDUSTRIAL APPLICABILITY

According to the present invention, it is possible to reduce the loss of the power of the pump in combined operation of boom lowering and arm pushing.

EXPLANATION OF REFERENCE NUMERALS

A1 operation amount (example of prescribed operation amount)

R1 tandem circuit

R2 parallel line (example of parallel circuit)

R3 parallel line (example of parallel circuit)

T1 capacity characteristic (example of capacity characteristic in single boom lowering operation)

T2 capacity characteristic (example of capacity characteristic in single arm pushing operation)

T3 capacity characteristic (example of capacity characteristic in combined operation of boom lowering and arm pushing)

T4 capacity characteristic (example of capacity characteristic in combined operation of boom lowering and arm pushing)

1 hydraulic shovel (example of construction machine)

4 hydraulic control device 9 boom cylinder 10 arm cylinder 14 first pump 15 second pump 16 boom side control valve 17 first arm side control valve (example of arm side control valve)

19 boom operation member 20 arm operation member 21 boom operation sensor (example of boom operation detection member)

22 arm operation sensor (example of arm operation detection member)

30 controller (example of control unit)

The invention claimed is:

1. A hydraulic control device provided in a construction machine having a boom and an arm, the hydraulic control device comprising:

a boom cylinder that causes the boom to perform rising operation or lowering operation;

an arm cylinder that causes the arm to perform pushing operation or pulling operation with respect to the boom;

a variable capacity type first pump;

a second pump that is capable of supplying hydraulic oil to the arm cylinder;

a boom operation member that receives operation for driving the boom;

an arm operation member that receives operation for driving the arm;

a boom side control valve that is capable of switching, in accordance with an operation amount of the boom operation member, between a supply position where the hydraulic oil is supplied to the boom cylinder, and a neutral position where the supply of the hydraulic oil to the boom cylinder is stopped and where an opening for allowing passage of the hydraulic oil is provided;

an arm side control valve that controls supply and discharge of the hydraulic oil with respect to the arm cylinder by switching operation according to an operation amount of the arm operation member;

a tandem circuit that connects the boom side control valve and the arm side control valve in series to the first pump such that the arm side control valve is located downstream of the boom side control valve;

a parallel circuit that connects the boom side control valve and the arm side control valve in parallel to the first pump;

a restrictor that is provided in the parallel circuit in order to guide the hydraulic oil from the first pump preferentially to the boom side control valve over the arm side control valve;

a boom operation detection member that is capable of detecting the operation amount of the boom operation member;

an arm operation detection member that is capable of detecting the operation amount of the arm operation member; and a control unit that performs single control of increasing capacity of the first pump in accordance with increase in the operation amount of the boom operation member, in a single operation of the boom lowering, wherein the control unit restricts the capacity of the first pump compared to the capacity in the single control, during a restriction control period when combined operation of boom lowering and arm pushing is detected by the respective detection members, and the operation amount of the boom operation member is a prescribed operation amount or more, the control unit stores a characteristic of the capacity of the first pump in the single operation of the boom lowering, the characteristic of the capacity being set so as to increase in accordance with an increase in the operation amount of the boom lowering, and a prescribed upper limit capacity that is a characteristic of the capacity of the first pump in the combined operation of boom lowering and arm pushing and is set so as to decrease in accordance with increase in the operation amount of the boom lowering, and the prescribed operation amount is defined by an intersection of the characteristic of the capacity of the first pump in the single operation of the boom lowering and the prescribed upper limit capacity.

2. The hydraulic control device according to claim 1, wherein the control unit controls the capacity of the first pump to less than the prescribed upper limit capacity during the restriction control period.

3. The hydraulic control device according to claim 2, wherein the control unit stores an arm necessary capacity that is a characteristic of the capacity of the first pump and is set so as to increase in accordance with increase in the operation amount of the arm operation member, and controls the capacity of the first pump to a smaller capacity among a capacity determined by the arm necessary capacity and the operation amount of the arm operation member, and a capacity determined by the prescribed upper limit capacity and the operation amount of the boom operation member, in a whole operation range of the boom operation member, in a case where the combined operation of boom lowering and arm pushing is detected.

4. The hydraulic control device according to claim 3, wherein a maximum value of the prescribed upper limit capacity is set to be equivalent to or larger than a maximum value of the arm necessary capacity.

5. The hydraulic control device according to claim 2, wherein the control unit stores an arm necessary capacity that is a characteristic of the capacity of the first pump and is set so as to increase in accordance with increase in the operation amount of the arm operation member, and controls the capacity of the first pump to a smaller capacity among a capacity determined by the arm necessary capacity and the operation amount of the arm operation member, and the prescribed upper limit capacity, during the restriction control period.

6. A construction machine comprising:

a machine body;

a boom that is capable of performing rising operation or lowering operation with respect to the machine body;

an arm that is capable of performing pushing operation or pulling operation with respect to the boom; and the hydraulic control device according to claim 1, which controls driving of the boom and the arm.

* * * * *